US005916864A

United States Patent [19]

Fujino et al.

[11] Patent Number: 5,916,864

[45] Date of Patent: Jun. 29, 1999

[54] LAUNDRY DETERGENT COMPOSITION COMPRISING A COMBINATION OF A SPARINGLY WATER SOLUBLE SOLVENT AND AN EASILY WATER SOLUBLE SOLVENT

[75] Inventors: Tetsuya Fujino, Osaka; Yumi Goto, Hyogo; Takenori Fukugaki, Osaka; Yoshiaki Nakamura, Osaka; Yuji Murakami, Osaka, all of Japan

[73] Assignee: Sunstar Inc., Osaka, Japan

[21] Appl. No.: 08/897,636

[22] Filed: Jul. 21, 1997

[30] Foreign Application Priority Data

Jul. 24, 1996 [JP] Japan ..... 8-214268
Jul. 24, 1996 [JP] Japan ..... 8-214269

[51] Int. Cl.[6] ..... C11D 1/72; C11D 1/62; C11D 1/835; C11D 3/44

[52] U.S. Cl. ..... 510/356; 510/238; 510/281; 510/289; 510/308; 510/327; 510/329; 510/330; 510/331; 510/341; 510/342; 510/356; 510/362; 510/363; 510/384; 510/391; 510/504; 510/524; 510/525; 510/533

[58] Field of Search ..... 510/238, 281, 510/289, 308, 327, 329, 330, 331, 341, 342, 356, 362, 363, 384, 391, 504, 524, 525, 533

[56] References Cited

U.S. PATENT DOCUMENTS

| | | | |
|---|---|---|---|
| 3,862,058 | 1/1975 | Nirschl et al. | 252/528 |
| 3,928,213 | 12/1975 | Temple et al. | 252/8.8 |
| 4,222,905 | 9/1980 | Cockrell, Jr. | 252/547 |
| 4,239,659 | 12/1980 | Murphy | 252/524 |
| 4,259,217 | 3/1981 | Murphy | 252/547 |
| 4,639,321 | 1/1987 | Barrat et al. | 252/8.8 |
| 4,769,172 | 9/1988 | Siklosi | 252/153 |
| 4,828,723 | 5/1989 | Cao et al. | 252/8.8 |
| 4,851,141 | 7/1989 | Demangeon et al. | 252/8.75 |
| 5,051,212 | 9/1991 | Culshaw et al. | 252/546 |
| 5,066,413 | 11/1991 | Kellett | 252/8.75 |
| 5,447,575 | 9/1995 | Crump et al. | 134/42 |
| 5,597,792 | 1/1997 | Klier et al. | 510/417 |
| 5,658,651 | 8/1997 | Smith et al. | 442/59 |
| 5,730,760 | 3/1998 | Kirk et al. | 8/137 |
| 5,763,379 | 6/1998 | Janota | 510/245 |

FOREIGN PATENT DOCUMENTS

| | | | |
|---|---|---|---|
| 0691397 | 1/1996 | European Pat. Off. . | |
| 0698660 | 2/1996 | European Pat. Off. . | |
| 2672060 | 7/1992 | France . | |
| 47-4750 | 2/1972 | Japan . | |
| 57-126896 | 8/1982 | Japan | C11D 1/72 |
| 4-4298 | 1/1992 | Japan | C11D 1/835 |
| 4-153300 | 5/1992 | Japan | C11D 17/08 |
| 5-51598 | 3/1993 | Japan | C11D 7/50 |
| 6-313193 | 11/1994 | Japan | C11D 1/835 |
| 7-54264 | 2/1995 | Japan | D06L 1/14 |
| 8-48993 | 2/1996 | Japan | C11D 1/62 |
| 8-48994 | 2/1996 | Japan | C11D 1/62 |
| 8-48995 | 2/1996 | Japan | C11D 1/62 |

OTHER PUBLICATIONS

Database WPI Week 9734 Derwent Publications Ltd., London, GB; AN 97–369810 XP002048339 & JP 09 157 695 A (Sunstar Chem. Ind. Co.), Jun. 17, 1997 *abstract*.

Database WPI Week 9208 Derwent Publications Ltd., London, GB; AN 92–060176 XP002048340 & JP 04 004 298 A (Nippon Oils & Fats Co.), Jan. 8, 1992 *abstract*.

Database WPI Week 9617 Derwent Publications Ltd., London, GB; AN 96–167418 XP002048341 & JP 08 048 993 (Sunstar Chem. Ind. Co.), Feb. 20, 1996 *abstract*.

Database WPI Week 9617 Derwent Publications Ltd., London, GB; AN 96–167419 XP002048342 & JP 08 048 994 A (Sunstar Chem. Ind. Co.), Feb. 20, 1996 *abstract*.

Database WPI Week 9617 Derwent Publications Ltd., London, GB; AN 96–167420 XP002048343 & JP 08 048 995 A (Sunstar Chem. Inc. co.), Feb. 20, 1996 *abstract*.

*Primary Examiner*—Mark Kopec
*Assistant Examiner*—Charles Boyer
*Attorney, Agent, or Firm*—Sughrue, Mion, Zinn, Macpeak & Seas, PLLC

[57] ABSTRACT

A laundry detergent composition is disclosed which comprises: (A) a nonionic surfactant represented by formula (1); (B) at least one cationic surfactant represented by formula (2) wherein the cationic surfactant has a whole iodine value of 40 to 100; (C) at least one sparingly water-soluble solvent selected from a solvent represented by formula (3) and a solvent represented by formula (4); and (D) at least one easily water-soluble solvent selected from a solvent represented by formula (5) and a solvent represented by formula (6).

7 Claims, No Drawings

LAUNDRY DETERGENT COMPOSITION COMPRISING A COMBINATION OF A SPARINGLY WATER SOLUBLE SOLVENT AND AN EASILY WATER SOLUBLE SOLVENT

BACKGROUND OF THE INVENTION

1. Field of the Invention

This invention relates a liquid laundry detergent which exhibits good detergency even against stubborn oil stains by the application to them in the undiluted form, and permits practical laundering even in soak washing. More specifically, this invention relates to a laundry detergent composition exhibiting both practical detergency and shape-retaining function for silk, wool or delicate clothing, which requires washing even when it is slightly stained, by subjecting it to soak washing. Particularly, this invention pertains to a detergent composition exclusively used for soak washing, which composition exhibits markedly high detergency against oil stains (almost unremovable by washing with water) when applied in the undiluted form and imparts excellent touch feeling compared with the conventional laundry detergent composition.

2. Description of the Related Art

In general, the term "soak washing" conventionally means preliminary washing before washing by a washing machine or by rubbing the laundry with hands, soaking it in a detergent solution which has detergency heightened by the addition of an enzyme. Because the stain cannot be removed sufficiently from the laundry without soaking it in a detergent solution for a long time (ex. overnight), silk or wool garments soaked for such a long time tend to cause shrinkage. The term "soak washing" as used herein means, on the other hand, washing by soaking the laundry in a detergent for a time as short as 10 to 30 minutes and such a short-time soak washing is accompanied with the advantages that it is free from inconvenience, such as shrinkage, of delicate clothing such as silk or wool garments, can accelerate the removal of stain and can finish the laundry with good touch feeling.

In home laundering, clothes are conventionally washed with a detergent mainly composed of an anionic surfactant or nonionic surfactant, followed by softening treatment with a softener mainly composed of a cationic surfactant to impart them with good touch feeling and antistatic capacity. This conventional method is inconvenient, because it requires two separate operations, that is, washing and softening. A washing method using a one-pack type laundry detergent composition in which the above two separate operations are conducted at the same time is disclosed in JP-B-47-4750 (the term "JP-B" as used herein means an "examined published Japanese patent publication") and JP-A-57-126896 (the term "JP-A" as used herein means an "unexamined published Japanese patent application).

The above-described one-pack type composition is composed of a nonionic surfactant or semi-polar surfactant as a main component and as a softener component, a monoalkyl or dialkyl type cationic surfactant containing in its molecule a long-chain saturated group. This system is clear (transparent) at normal temperatures for a while after incorporation. After a long-term storage, however, it separates out insoluble matters and becomes turbid (clouded) or causes precipitation at low temperatures, thereby markedly deteriorating the commodity value. As a result, the one-pack type composition involves a problem in stability in spite of having proper performance in detergency and touch feeling, which makes it difficult to carry out industrial production.

Disclosed in JP-A-4-4298, JP-A-4-153300, U.S. Pat. No. 4,222,905, U.S. Pat. No. 4,259217, U.S. Pat. No. 4,239,659 or the like is a clear neutral liquid detergent having a nonionic surfactant and a cationic surfactant as a basic skeleton. In other words, in the above publications, a clear neutral liquid detergent which has proper detergency, does not impair excellent touch feeling and has excellent storage stability in spite of being a one-pack type detergent is described. Even if the above detergent is employed, delicate clothing, particularly silk or wool garments shrink or lose its original shape after washing by the conventional washing method, more specifically, by washing in a mild water stream in a washing machine or washing by rubbing or pressing the clothing with hands, which considerably deteriorates the commodity value of the clothing. As a washing method to prevent the clothing from shrinkage or to allow the clothing to retain its original shape, a soak washing method is known but for this method, the above detergent is insufficient in detergency and is inferior in the effects for removing the partly marked stains. In addition, a washing method or a detergent which is excellent in tough feeling after washing and shape-retaining function and also in washing function has been demanded. In JP-A-7-54264, JP-A-6-313193, JP-A-8-48993, JP-A-8-48994 and JP-A-8-48995, it is therefore described that an easily water-soluble solvent is incorporated in a laundry detergent composition to make it easier to remove the stubborn oil stains which are hard to be removed by washing in a water system.

In recent days, dry cleaning has caused a serious environmental problem because a solvent such as chlorofluorocarbon (e.g., freon), perchloroethylene (tetrachloroethylene) or petroleum adversely affecting the environment is used in a large amount and in addition, dry cleaning has drawn attentions because of its insufficient removal of water-soluble stain. Delicate clothing, particularly silk or wool garments, should be subjected to dry cleaning for the removal of stubborn oil stains, because ordinary washing method (more specifically, washing in a mild water stream in a washing machine or washing by rubbing or pressing with hands) cannot be adopted for them. It is therefore reported in JP-A-5-51598 that a new dry cleaning solvent using a glycol ether solvent has brought about an improvement in the environmental safety and removal of water-soluble stain. Even when the solvent is used, the removal of water-soluble stain however is not sufficient compared with washing in a water system and this problem has not been overcome sufficiently by the dry cleaning using a solvent.

Under such circumstances, clothes for which the ordinary washing method is not suitable, for example, delicate clothes, particularly silk or wool garments are inevitably washed by the method laying stress on either water-soluble stains or stubborn oil stains.

There is accordingly a demand for a laundry detergent composition which has detergency and touch feeling equal or superior to the conventional soak washing detergent, facilitates the removal of stubborn oil stains, which has so far been removed only by dry cleaning, and is effective for the removal of water-soluble stains and also stubborn oil stains.

SUMMARY OF THE INVENTION

An object of the present invention is to provide a laundry detergent composition exclusively used for soak washing, which has practical detergency and shape-retaining function for delicate clothing particularly silk or wool garments; can impart the laundry with excellent softness and touch feeling after washing; can remove the stubborn oil stains well by the application of it in the undiluted form to only the stained place; and has low viscosity and is stable at normal and low temperatures There is thus provided a laundry detergent composition comprising (A) a nonionic surfactant represented by the following formula (1):

$$R_1O(CH_2CH_2O)_nH$$

wherein $R_1$ represents a linear or branched $C_{10-22}$ alkyl or alkenyl group or an alkylphenyl group having a $C_{6-12}$ alkyl group and n stands for 5 to 15;

(B) one or more cationic surfactants each of which is represented by the following formula (2):

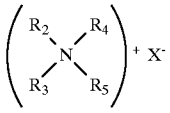

wherein $R_2$, $R_3$, $R_4$ and $R_5$ are independent of each other and two of them represent a $C_{2-24}$ alkyl or alkenyl group and the remaining two represent a methyl, ethyl, polyoxyethylene or polyoxypropylene group, X represents a halogen atom, $CH_3SO_4$ or $C_2H_5SO_4$, and the cationic surfactant has a whole iodine value of 40 to 100;

(C) one or more sparingly water-soluble solvents selected from those represented by the following formula (3):

$$R_6OH$$

wherein $R_6$ represents a linear or branched $C_{6-12}$ alkyl group or an alkylphenyl group having a linear or branched $C_{5-12}$ alkyl group, and those represented by the following formula (4):

$$R_7(OR_8)_mOH$$

wherein $R_7$ represents a linear or branched $C_{5-12}$ alkyl group or an alkylphenyl group having a linear or branched $C_{5-12}$ alkyl group, $R_8$ represents a $C_{2-5}$ alkylene group and m stands for 1–3; and (D) one or more easily water-soluble solvents selected from those represented by the formula (5):

$$R_9OH$$

wherein $R_9$ represents a linear or branched $C_{1-5}$ alkyl group or a benzyl group, and those represented by the following formula (6):

$$R_{10}(OR_{11})_lOH$$

wherein $R_{10}$ represents a linear or branched $C_{1-4}$ alkyl or alkylene group, a phenyl group, a benzyl group or a hydrogen atom, $R_{11}$ represents a linear or branched $C_{2-5}$ alkylene group and l stands for 1–3. The composition may further contain (E) an amidobetaine amphoteric surfactant and/or (F) a salt having water solubility of 10 wt. % or greater.

DETAILED DESCRIPTION OF THE PREFERRED EMBODIMENTS

The nonionic surfactant of the formula (1) usable in the present invention is an ethylene oxide added type nonionic surfactant. Examples include polyoxyethylene alkyl or alkenyl ethers each of which has a $C_{10-22}$ alkyl or alkenyl group and has 5 to 15 moles of added ethylene oxide; and polyoxyethylene alkylphenyl ethers having a $C_{6-12}$ alkyl group. They can be used either singly or in combination. The nonionic surfactant is preferably added in an amount of 10 to 50 wt. %, more preferably 15 to 40 wt. %, based on the total amount of the composition. Amounts less than 10 wt. % lead to not only weak detergency but also reduced stability at low temperatures. Amounts greater than 50 wt. %, on the other hand, deteriorate the solubility at normal temperatures and the resulting composition tends to take a gel form. The upper limit of the addition amount of the nonionic surfactant is preferably 30 wt. % based on the total amount of the composition.

As the cationic surfactant of the formula (2), one or more di(long-chain alkyl) quaternary ammonium salts can be used in the present invention. The whole iodine value of the cationic surfactant ranges from 40 to 100. The di(long-chain alkyl) may be either alkyl or alkenyl group and it has carbon atoms of 12 to 24, preferably 16 to 20. When the number of the carbon atoms of the long-chain alkyl is less than 12, the resulting composition cannot impart the fabric with sufficient softness or touch feeling after washing. When the number of the carbon atoms exceeds 24, on the other hand, the resulting composition cannot form a clear solution at low temperatures. Incidentally, two long-chain alkyl groups may be the same or different.

The remaining two are any two of alkyl groups such as methyl and ethyl, and polyoxyethylene or polyoxypropylene group whose added moles are 1 to 5, with a methyl group being preferred. X represents any one of halogen atoms such as chlorine, bromine or iodine, $CH_3SO_4$ and $C_2H_5SO_4$, with chlorine being preferred.

Preferred examples of the di(long-chain alkyl) quaternary ammonium salts include dioleyl dimethylammanium chloride and dialkyl dimethylamonium chloride containing a unsaturated alkyl group mixture derived from oleic acid, tallow fatty acid and/or soybean oil fatty acid, with dioleyl dimethyl-ammonium chloride being particularly preferred. When they are used in combination, a di(long-chain alkyl) quaternary ammonium salt containing a saturated alkyl group such as distearyl dimethylammonium chloride may be added to that containing an unsaturated alkyl group such as dioleyldimethyl ammonium chloride.

The cationic surfactant of the present invention has an iodine value ranging from 40 to 100, preferably 60 to 90. When more than two di(long alkyl) quaternary ammonium salts are used in combination, the total iodine value should be adjusted to fall within the above range. When the iodine value is less than 40, the stability at low temperatures is impaired. When it exceeds 100, on the other hand, storage stability is impaired.

The one or more cationic surfactants are preferably added in a total amount of 1 to 15 wt. %, more preferably 2 to 10 wt. %, based on the total amount of the composition. Amounts less than 1 wt. % do not impart the fabric with softness after washing. Amounts exceeding 15 wt. %, on the other hand, impair the stability at low temperatures, leading to the deterioration in detergency. The upper limit of the addition amount of the cationic surfactant is preferably 7 wt. % based on the total amount of the composition.

The sparingly water-soluble solvent usable in the present invention is one or more solvents selected from sparingly water-soluble alcohol solvents each represented by the following formula (3):

$R_6OH$ wherein $R_6$ represents a linear or branched $C_{6-12}$ alkyl group or an alkylphenyl group having a linear or branched $C_{5-12}$ alkyl group, and sparingly water-soluble glycol ether solvents each represented by the following formula (4):

$R_7(OR_8)_mOH$ wherein $R_7$ represents a linear or branched $C_{5-12}$ alkyl group or an alkylphenyl group having a linear or branched $C_{5-12}$ alkyl group, $R_8$ represents a $C_{2-5}$ alkylene group and m stands for 1–3.

Specific examples of the sparingly water-soluble alcohol solvent include 1-hexanol, 2-hexanol, 3-hexanol, 2-methyl-1-pentanol, 4-methyl-2-pentanol, 2-ethyl-1-butanol, 1-heptanol, 2-heptanol, 3-heptanol, 1-octanol, 2-octanol, 2-ethylhexanol, 1-nonal, 3,5,5-trimethyl-1-hexanol and 1-decanol. Specific examples of the sparingly water-soluble glycol ether solvent include ethylene glycol monohexyl ether and diethylene glycol mono-2-ethylhexyl ether. Among them, sparingly water-soluble glycol ether solvents are preferred, with diethylene glycol mono-2-ethylhexyl ether and diethylene glycol monohexyl ether being particularly preferred. It is preferred to add such a solvent in an amount of 1 to 40 wt. %, more preferably 1 to 20 wt. %, particularly 5 to 20 wt. %, based on the total amount of the composition. At amounts less than 1 wt. %, oil stain removal power is not sufficient. When the amount exceeds 40 wt. %, on the other hand, the resulting composition comes to have a problem in the storage stability.

The easily water-soluble solvent usable in the present invention is one or more solvents selected from easily water-soluble alcohol solvents each represented by the following formula (5):

$R_9OH$ wherein $R_9$ represents a linear or branched $C_{1-5}$ alkyl group or a benzyl group, and easily water-soluble glycol ether solvents each represented by the following formula (6):

$R_{10}(OR_{11})_lOH$ wherein $R_{10}$ represents a linear or branched $C_{1-4}$ alkyl or alkylene group, a phenyl, a benzyl group or a hydrogen atom, $R_{11}$ represents a linear or branched $C_{2-5}$ alkylene group and l stands for 1–3.

As the easily water-soluble alcohol solvent, ethanol, methanol or propanol, as the easily water-soluble ethylene glycol solvent, ethylene glycol or diethylene glycol, as the easily water-soluble diol solvent, propane diol or butane diol can be used, respectively. Specific examples of the easily water-soluble glycol ether solvent include ethylene glycol monomethyl ether, ethylene glycol monoethyl ether, ethylene glycol monobutyl ether, isopropylene glycol monomethyl ether, isopropylene glycol monoethyl ether and 3-methoxybutanol, 3-methyl-3-methoxybutanol. Among them, easily water-soluble glycol ether solvent are preferred, with isopropylene glycol monomethyl ether, isopropylene glycol monoethyl ether, 3-methoxybutanol and 3-methyl-3-methoxybutanol being particularly preferred. One or more easily water-soluble solvents are preferably added in an amount of 0.1 to 30 wt. %, more preferably 0.1 to 20 wt. %, particularly 2 to 20 wt. %, based on the total amount of the composition. When the amount is outside the above range, storage stability is impaired. The upper limit of the addition amount of the easily water-soluble solvent is preferably 15 wt. % based on the total amount of the composition.

Examples of the amidobetaine amphoteric surfactant usable in the present invention include stearylamidopropyldimethyl aminoacetic betaine and coconut oil fatty acid amidopropyldimethyl aminosulfobetaine, with coconut oil fatty acid amidopropyldimethyl aminoacetic betaine being particularly preferred. It is preferred to add such an amphoteric surfactant in an amount of 0.01 to 2.0 wt. %, particularly 0.1 to 1.0 wt. % based on the total amount of the composition. The addition of the amidobetaine amphoteric surfactant within the above range results in more improved finish of clothing.

As a salt which has water solubility (at a standard state (25° C.)) of 10 wt. % or more and is usable in the present invention, any one of salts with an inorganic acid or organic acid can be used. It is possible to use the salt in the form of a salt or to prepare it from an acid and an alkali during the steps for the preparation of the composition. Examples of the salt with an inorganic acid include chlorides, sulfates, nitrates, carbonates, bicarbonates and borates with sodium, potassium or ammonium. Examples of the salts with an organic acid include citrates, benzoates, succinates and lactates. Preferred examples of the inorganic acid salt include sodium chloride and sodium sulfate, while those of the organic acid salt include sodium citrate. The above-exemplified salts can be used either singly or in combination. It is preferred to add the salt in an amount not greater than 5.0 wt. %, with not greater than 2.0 wt. % being particularly preferred. Amounts not greater than 5.0 wt. % are preferred from the viewpoint of stability. The lower limit of the addition amount of the salt having water solubility of 10 wt. % or more is preferably 0.01 wt. % based on the total amount of the composition.

The composition of the present invention can be prepared in a manner known per se in the art. The composition can be used for various stains for clothing or bathrooms. It is suited to use the composition as a liquid detergent for clothing, particularly as a low-viscosity (5 to 500 cps: Brookfield type viscometer; spindle #2) liquid detergent for soak washing.

In the present invention, it is also possible to add as needed a conventionally-known water-soluble polymer such as polyvinyl alcohol, carboxymethyl cellulose, hydroxypropylmethyl cellulose or hydroxybutyl cellulose, anionic surfactant, semi-polar surfactant such as amine oxide, perfume, enzyme (proteolytic enzyme, lipidolytic enzyme, amylolytic enzyme, lysokinase or the like), bactericide, pigment and/or dye insofar as it does not impair the advantages of the present invention.

EXAMPLES

The present invention will hereinafter be described more specifically by the following examples. Needless to say, it should however be borne in mind that the present invention is not limited to or by these examples, in which all designations of % indicate wt. % unless otherwise specifically indicated.

Compositions in Examples (and Comparative Examples) shown in Table 1 were prepared in a manner known per se in the art and they were evaluated by a stability test, softness test, undiluted solution application test and soak washing detergency test. The evaluation methods will be described below. Incidentally, tap water was employed in each test.

Evaluation Methods

1. Stability Test

In 100-ml screw pipes, compositions of Examples and Comparative Examples were charged, respectively. They were allowed to stand for a month in constant temperature baths maintained at −5° C., 0C, 5° C. and 25° C., respectively. External appearance was visually judged.

Evaluation is conducted in accordance with the following standards and the composition evaluated as A is judged as good.

A: clear and having fluidity

B: translucent and having fluidity

C: turbid, precipitation of crystals or solidification occurred.

2. Softness Test

In each of the compositions (30° C., 500 ml of a 0.1% aqueous solution) of Examples and Comparative Examples, a 20 cm×20 cm silk cloth (100% silk plain cloth) was subjected to 5 cycles of washing operation comprising soaking for 10 minutes, rinsing twice by shaking, dehydrating for 10 seconds, and air drying. After the completion of the 5 cycles, an iron was applied to the cloth at: low temperatures, whereby a test cloth was prepared. The softness of the cloth was judged by paired comparison with unwashed cloth in accordance with organoleptic evaluation.

Evaluation standards are as follows and those ranked as A or B come up to the standard.

A: much softer than unwashed silk cloth

B: softer than unwashed silk cloth

C: slightly harder than unwashed silk cloth

D: harder than unwashed silk cloth

3. Test on Detergency When Undiluted Solution is Applied

Each of the compositions of Examples and Comparative Examples was applied to 5 lard-stained clothes and 5 lipstick-stained clothes, each 5 cm×5 cm, in an amount of 1 ml per cloth and they were allowed to stand for 15 minutes. Each of thus-treated clothes was then soaked in 10 l of water for soak washing. Concerning the detergency of lard-stained clothes, the reflectances of the artificially-stained cloth before washing, that after washing and white cloth (control) were measured by a color difference meter ("ZE-2000", trade name; manufacture of Nippon Denshoku Kogyo) and the detergency of the lard-stained cloth after washing was calculated in accordance with the below-described formula. Incidentally, the detergency is indicated by an average value of five clothes and the composition having a detergency of 60% or more is judged effective.

$$Detergency(\%) = \frac{R_w - R_s}{R_o - R_s} \times 100$$

$R_o$: surface reflectance of white cloth $R_s$: surface reflectance of stained cloth before washing $R_w$: surface reflectance of stained cloth after washing On the other hand, the detergency of lipstick-stained clothes was evaluated by five monitors. The stained condition before washing was designated as 5 points and the original white cloth was designated as 1 point. Based on them, the detergency of the composition was evaluated by an average value of five clothes. Evaluation standards are as follows and the composition evaluated as 2.5 points or lower is regarded to come up to the standard.

1: the lipstick stain is completely removed.

2: the lipstick stain remains slightly outline can be recognized).

3. the lipstick stain remains.

4. most of the lipstick stain remains 5. the lipstick stain is the same with that before washing The lard-stained cloth and lipstick-stained cloth were prepared and washed as follows:

Preparation Method of Lipstick-stained Cloth

A commercially-available lipstick was applied thinly to a 5 cm×5 cm unbleached muslin cloth in an amount of 25 mg/cloth.

Washing Conditions

| | |
|---|---|
| Washing time (soaking time) | 15 minutes |
| Washing temperature | 25° C. |
| Rinsing | rinsing by shaking |
| Dehydration | dehydration by putting the cloth between a washed and dried white towel |

4. Test on Soak Washing Detergency

In 1 liter of each of the aqueous solutions of Examples and Comparative Examples, 5 artificially stained clothes of Washing Science Association having a size of 5 cm×5 cm were immersed and subjected to soak washing, and then detergency was evaluated. The reflectance of each of the artificially-stained cloth before washing, that after washing and white cloth (control) was measured by a color difference meter ("ZE-2000", trade name; manufacture of Nippon Denshoku Kogyo) and detergency was calculated based on the following formula:

$$\text{Detergency } (\%) = \frac{R_w - R_s}{R_o - R_s} \times 100$$

$R_o$: surface reflectance of white cloth $R_s$: surface reflectance of stained cloth before washing $R_w$: surface reflectance of stained cloth after washing.

Incidentally, the detergency is indicated by an average value of five clothes and the composition having a detergency of 15% or more is judged effective. Washing is conducted under the following conditions:

Washing Conditions

| | |
|---|---|
| Washing time (soaking time) | 15 minutes |
| Laundry detergent composition | 0.1% |
| Washing temperature | 25° C. |
| Rinsing | rinsing by shaking |
| Dehydration | dehydration by putting the cloth between a washed and dried white towel |

TABLE 1

| Component | Example 1 | Example 2 | Example 3 | Example 4 | Example 5 | Example 6 | Example 7 |
|---|---|---|---|---|---|---|---|
| Diethylene glycol monohexyl ether (%) | 5.00 | 20.00 | — | — | 7.00 | — | — |
| Hexanol (%) | — | — | 5.00 | — | — | — | — |
| Diethylene glycol mono-2-ethylhexyl ether (%) | — | — | — | 7.00 | — | 5.00 | 10.00 |
| Dioleyldimethyl ammonium chloride (iodine value: 75) (%) | 4.00 | 4.00 | 1.00 | 7.00 | 4.00 | 4.00 | 8.00 |
| POE (9) C12-l5 alkyl ether* (%) | 20.00 | 30.00 | 25.00 | 20.00 | 25.00 | 25.00 | 50.00 |
| Ethanol (%) | 0.10 | — | 5.00 | — | — | — | — |
| Ethylene glycol (%) | — | — | — | — | 5.00 | — | — |
| 3-Methyl-3-mothoxybutanol (%) | — | 10.00 | — | 7.00 | — | 5.00 | 10.00 |
| Coconut oil fatty acid amidopropyldimehtyl aminoacetic betain (%) | — | — | — | — | — | 0.10 | 0.20 |
| Lauryldimethylamine oxide (%) | — | — | — | — | — | — | — |
| Sodium sulfate (%) | — | — | 0.50 | 1.00 | 1.00 | 1.50 | — |
| Sodium citrate (%) | 0.01 | — | — | — | — | 0.20 | — |
| Ion-exchange water (%) | Balance | Balance | Balance | Balance | Balance | Balance | Balance |
| Total (%) | 100 | 100 | 100 | 100 | 100 | 100 | 100 |
| Evaluation | | | | | | | |
| Softness test | B | B | B | B | B | A | A |
| Detergency test (%) | 60 | 75 | 70 | 70 | 65 | 70 | 98 |
| Lard | | | | | | | |
| Lipstick | 2.5 | 1.5 | 2 | 1.5 | 2 | 1.5 | 1 |
| Soak washing | 15 | 18 | 23 | 20 | 18 | 20 | 25 |
| Stability test | | | | | | | |
| 25° C. | A | A | A | A | A | A | A |
| −5° C., 0° C., 5° C. | A | A | A | A | A | A | A |

| Compound | Comp. Example 1 | Comp. Example 2 | Comp. Example 3 | Comp. Example 4 | Comp. Example 5 | Comp. Example 6 |
|---|---|---|---|---|---|---|
| Diethylene glycol monohexyl ether (%) | — | 25.00 | — | 5.00 | — | — |
| Hexanol (%) | — | — | — | — | 10.00 | — |
| Diethylene glycol-2-hexyl ether (%) | — | — | — | — | — | 10.00 |
| Dioleyldimethyl ammonium chloride (iodine value: 75) (%) | 4.00 | 4.00 | 4.00 | — | 10.00 | 4.00 |
| POE (9) C12-15 alkyl ether* (%) | 30.00 | 25.00 | 25.00 | 35.00 | — | 25.00 |
| Ethanol (%) | — | — | — | 5.00 | — | — |
| Ethylene glycol (%) | — | — | — | — | 10.00 | — |
| 3-Methyl-3-mothoxybutanol (%) | — | — | 10.00 | — | — | — |
| Coconut oil fatty acid amidopropyldimehtyl aminoacetic betain (%) | — | — | — | — | — | — |
| Lauryldimethylamine oxide (%) | — | — | 0.10 | — | — | — |
| Sodium sulfate (%) | — | — | — | — | — | 4.00 |
| Sodium citrate (%) | — | — | — | — | — | 2.00 |
| Ion-exchange water (%) | Balance | Balance | Balance | Balance | Balance | Balance |
| Total (%) | 100 | 100 | 100 | 100 | 100 | 100 |
| Evaluation | | | | | | |
| Softness test | B | — | B | D | — | — |
| Detergent test (%) | 40 | — | 45 | 60 | — | — |
| Lard | | | | | | |
| Lipstick | 4 | — | 3.5 | 2 | — | — |
| Soak washing | 12 | — | 17 | 20 | — | — |
| Stability test | | | | | | |
| 25° C. | A | C | A | A | C | C |
| −5° C., 0° C., 5° C. | A | C | A | A | C | C |

Remarks: POE (9) C12-15 alkyl ether represents polyoxyethylene $C_{12-15}$-alkyl ether.

As a result of comparison between the compositions of Examples and Comparative Examples shown in Table 1, it has been found that the laundry detergent compositions of the present invention are excellent in stability, softness, detergency against stubborn oil stains and detergency by soak washing. Accordingly, it has been recognized that in the present invention, a laundry detergent composition which can be employed conveniently because it is a liquid having stable viscosity at low temperatures, can remove stubborn oil stains easily, and has various properties such as practical detergency, shape-retaining function, softness of washed fibers and touch feeling can be prepared by incorporating a nonionic surfactant, cationic surfactant, sparingly water-soluble solvent, easily water-soluble solvent, amidobetaine amphoteric surfactant and inorganic salt.

Upon washing of delicate clothing such as silk or wool garments, the laundry detergent composition according to the present invention has practical detergency and shape-retaining function, can impart excellent softness and touch feeling to the fabric after washing and, in particular, can remove stubborn oil stains well by the application of it in the undiluted form.

It should further be apparent to those skilled in the art that various changes in form and detail of the invention as shown and described above may be made. It is intended that such changes be inclined with in the spirit and scope of the claimed appended hereto.

What is claimed is:

1. A laundry detergent composition comprising:

(A) 15 to 40 wt % of a nonionic surfactant represented by formula (1):

$$R_1O(CH_2CH_2O)_nH \quad (1)$$

wherein $R_1$ represents a linear or branched $C_{10-22}$ alkyl or alkenyl group or an alkylphenyl group having a $C_{6-12}$ alkyl group and n is 5 to 15;

(B) 2 to 10 wt % of at least one cationic surfactant represented by formula (2):

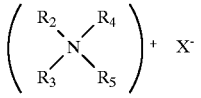

(2)

wherein $R_2$, $R_3$, $R_4$ and $R_5$, are independent of each other and two of them represent a $C_{12-24}$ alkyl or alkenyl group and the remaining two represent a methyl, ethyl, polyoxyethylene or polyoxypropylene group; and X represents a halogen atom, $CH_3SO_4$ or $C_2H_5SO_4$, and said at least one cationic surfactant has a whole iodine value of 60 to 90;

(C) 1 to 40 wt % of at least one sparingly water-soluble solvent selected from a solvent represented by formula (3) and a solvent represented by formula (4):

$$R_6OH \quad (3)$$

wherein R6 represents a linear or branched $C_{6-12}$ alkyl group, or an alkylphenyl group having a linear or branched $C_{5-12}$ alkyl group;

$$R_7(OR_8)_mOH \quad (4)$$

wherein $R_7$ represents a linear or branched $C_{5-12}$ alkyl group, or an alkylphenyl group having a linear or branched $C_{5-12}$ alkyl group; $R_8$ represents a $C_{2-5}$ alkylene group; and m is 1 to 3; and (D) 0.1 to 30 wt % of at least one easily water-soluble solvent selected from a solvent represented by formula (5) and a solvent represented by formula (6):

$$R_9OH \quad (5)$$

wherein $R_9$ represents a linear or branched $C_{1-5}$ alkyl group or a benzyl group;

$$R_{10}(OR_{11})_lOH \quad (6)$$

wherein $R_{10}$ represents a linear or branched $C_{1-4}$ alkyl or alkylene group, a phenyl group, a benzyl 3group or a hydrogen atom; $R_{11}$ represents a linear or branched $C_{2-5}$ alkylene group; and l is 1 to 3.

2. A laundry detergent composition comprising:

(A) 15 to 40 wt % of a nonionic surfactant represented by formula (1):

$$R_1O(CH_2CH_2O)_nH \quad (1)$$

wherein $R_1$ represents a linear or branched $C_{12-20}$ alkyl or alkenyl group or an alkylphenyl group having a $C_{6-12}$ alkyl group and n is 5 to 15;

(B) 2 to 10 wt % of at least one cationic surfactant represented by formula (2):

(2)

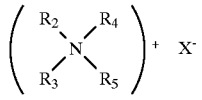

wherein $R_2$, $R_3$, $R_4$ and $R_5$, are independent of each other and two of them represent a $C_{12-24}$ alkyl or alkenyl group and the remaining two represent a methyl, ethyl, polyoxyethylene or polyoxypropylene group; and X represents a halogen atom, $CH_3SO_4$ or $C_2H_5SO_4$, and said at least one cationic surfactant has a whole iodine value of 60 to 90;

(C) 1 to 40 wt % of at least one sparingly water-soluble solvent selected from a solvent represented by formula (3) and a solvent represented by formula (4):

$$R_6OH \quad (3)$$

wherein $R_6$ represents a linear or branched $C_{6-12}$ alkyl group, or an alkylphenyl group having a linear or branched $C_{5-12}$ alkyl group;

$$R_7(OR_8)_mOH \quad (4)$$

wherein $R_7$ represents a linear or branched $C_{5-12}$ alkyl group, or an alkylphenyl group having a linear or branched $C_{5-12}$ alkyl group; $R_8$ represents a $C_{2-5}$ alkylene group; and m is 1 to 3; and (D) 0.1 to 30 wt % of at least one easily water-soluble solvent selected from a solvent represented by formula (5) and a solvent represented by formula (6):

$$R_9OH \quad (5)$$

wherein $R_9$ represents a linear or branched $C_{1-5}$ alkyl group or a benzyl group or a benzyl group;

$$R_{10}(OR_{11})_lOH \quad (6)$$

wherein $R_{10}$ represents a linear or branched $C_{1-4}$ alkyl or alkylene group, a phenyl group, a benzyl group or a hydrogen atom; $R_{11}$ represents a linear or branched $C_{2-5}$ alkylene group; and l is 1 to 3.

3. A laundry detergent composition comprising:

(A) 15 to 40 wt % of a nonionic surfactant represented by formula (1):

$$R_1O(CH_2CH_2O)_nH \quad (1)$$

wherein $R_1$ represents a linear or branched $C_{12-16}$ alkyl or alkenyl group or an alkylphenyl group having a $C_{6-12}$ alkyl group and n is 5 to 15;

(B) 2 to 10 wt % of at least one cationic surfactant represented by formula (2):

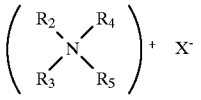

(2)

wherein $R_2$, $R_3$, $R_4$ and $R_5$, are independent of each other and two of them represent a $C_{12-24}$ alkyl or alkenyl group and the remaining two represent a methyl, ethyl, polyoxyethylene or polyoxypropylene group; and X represents a halogen atom, $CH_3SO_4$ or $C_2H_5SO_4$, and said at least one cationic surfactant has a whole iodine value of 60 to 90;

(C) 1 to 40 wt % of at least one sparingly water-soluble solvent selected from a solvent represented by formula (3) and a solvent represented by formula (4):

$$R_6OH \quad (3)$$

wherein $R_6$ represents a linear or branched $C_{6-8}$ alkyl group, or an alkylphenyl group having a linear or branched $C_{5-12}$ alkyl group;

$$R_7(OR_8)_mOH \quad (4)$$

wherein $R_7$ represents a linear or branched $C_{5-12}$ alkyl group, or an alkylphenyl group having a linear or branched $C_{5-12}$ alkyl group; $R_8$ represents a $C_{2-5}$ alkylene group; and m is 1 to 3; and (D) 0.1 to 30 wt % of at least one easily water-soluble solvent selected from a solvent represented by formula (5) and a solvent represented by formula (6):

$$R_9OH \quad (5)$$

wherein $R_9$ represents a linear or branched $C_{1-5}$ alkyl group or a benzyl group;

$$R_{10}(OR_{11})_lOH \quad (6)$$

wherein $R_{10}$ represents a linear or branched $C_{1-4}$ alkyl or alkylene group, a phenyl group, a benzyl group or a hydrogen atom; $R_{11}$ represents a linear or branched $C_{2-5}$ alkylene group; and l is 1 to 3.

4. A laundry detergent composition according to claim 1, further comprising 0.01 to 2 wt. % of an amidobetaine amphoteric surfactant.

5. A laundry detergent composition according to claim 1, further comprising 0.01 to 5 wt. % of a salt having water solubility of not lower than 10 wt. %.

6. A laundry detergent composition according to claim 4, further comprising 0.01 to 5 wt. % of a salt having water solubility of not lower than 10 wt. %.

7. A laundry detergent composition according claim 1, which is a liquid detergent for clothing suitable for use in soak washing.

* * * * *